US005104260A

United States Patent [19]

Trevisani

[11] Patent Number: 5,104,260

[45] Date of Patent: Apr. 14, 1992

[54] METHOD AND APPARATUS FOR TUNNELLING

[75] Inventor: Davide Trevisani, Cesena, Italy

[73] Assignee: Trevi S.p.A., Cesena, Italy

[21] Appl. No.: 509,538

[22] Filed: Apr. 16, 1990

[30] Foreign Application Priority Data

Apr. 28, 1989 [IT] Italy ..... 3446 A/89

[51] Int. Cl.[5] ..... E21D 9/10; E21D 11/10

[52] U.S. Cl. ..... 405/138; 37/191 A; 299/82; 405/140

[58] Field of Search ..... 405/132, 138, 139, 140, 405/145, 146, 150; 37/191 R, 191 A; 299/82

[56] References Cited

U.S. PATENT DOCUMENTS

| | | | |
|---|---|---|---|
| 839,856 | 1/1907 | Keays | 405/146 X |
| 1,242,217 | 10/1917 | McAlpine | 405/139 |
| 1,777,439 | 10/1930 | Lamont | 37/191 R X |
| 2,182,477 | 12/1939 | Hollingsworth | 405/138 |
| 2,939,692 | 6/1960 | Russell et al. | 299/82 X |
| 3,597,929 | 8/1971 | Bodine | 405/140 |
| 4,666,336 | 5/1987 | Murakami et al. | 405/138 |

FOREIGN PATENT DOCUMENTS

| | | |
|---|---|---|
| 0282416 | 3/1988 | European Pat. Off. . |
| 1008681 | 3/1957 | Fed. Rep. of Germany . |
| 2264358 | 12/1972 | Fed. Rep. of Germany . |
| 2123846 | 1/1971 | France . |
| 2138214 | 5/1971 | France . |
| 2268613 | 4/1974 | France . |
| 2305583 | 3/1975 | France . |

*Primary Examiner*—David H. Corbin

*Attorney, Agent, or Firm*—Guido Modiano; Albert Josif

[57] ABSTRACT

The method for boring a tunnel consists in placing an excavation tool at a point of the extrados of the tunnel and in excavating a cavity by imparting the tool an advancement movement having divergent direction with respect to the axis of the tunnel. While the cavity is being filled with concrete, a further cavity is excavated in another point of the extrados and is then also filled with concrete. These operations are repeated until a plurality of voussoirs is obtained which are arranged adjacent to one another along the extrados and give rise to a frustum-shaped vault. The soil inside the vault is then excavated for a depth which is smaller than the axial extension of the vault itself, and a subsequent vault is formed having a narrower initial portion internal to the wider terminal portion of the previously executed vault.

3 Claims, 5 Drawing Sheets

METHOD AND APPARATUS FOR TUNNELLING

BACKGROUND OF THE INVENTION

The present invention relates to a method and an apparatus for tunnelling.

The conventional method for tunnelling entails the use of a "shield mill" which bores the entire cross-section of the tunnel, the final supporting structure of the tunnel being produced behind said mill.

This method has limitations due to the need to have a shield which has exactly the dimensions of the tunnel to be bored and cannot therefore be used in tunnels with different geometry.

Considerable excavation power is furthermore required. Another disadvantage is to be seen in the fact that in loose soil a downward thrust component is induced which is due to the weight of the excavation tool and is difficult to control.

SUMMARY OF THE INVENTION

The technical aim of the present invention is therefore to provide a method for tunnelling which obviates the disadvantages of conventional methods.

Within the scope of this aim, an object is to provide an apparatus for carrying out the method.

BRIEF DESCRIPTION OF THE DRAWINGS

The characteristics and advantages of the invention will become apparent from the description of a preferred but non-limitative embodiment of the apparatus for performing the method, illustrated only by way of non-limitative example in the accompanying drawings, wherein.

Figure 3:
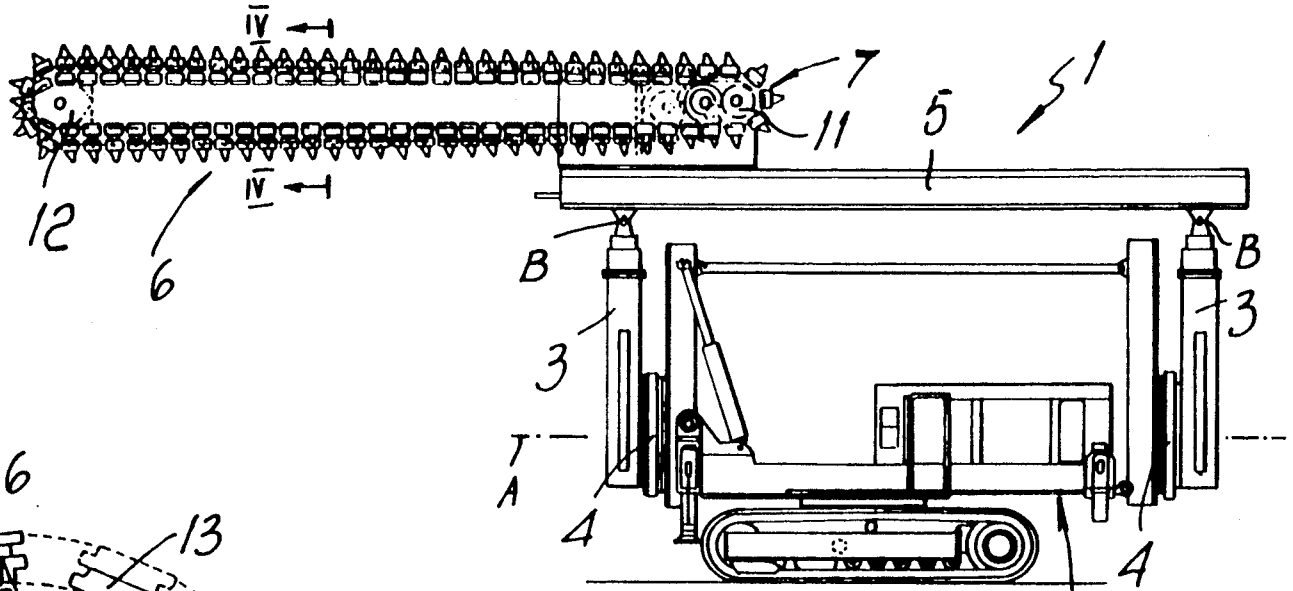
Figure 5:
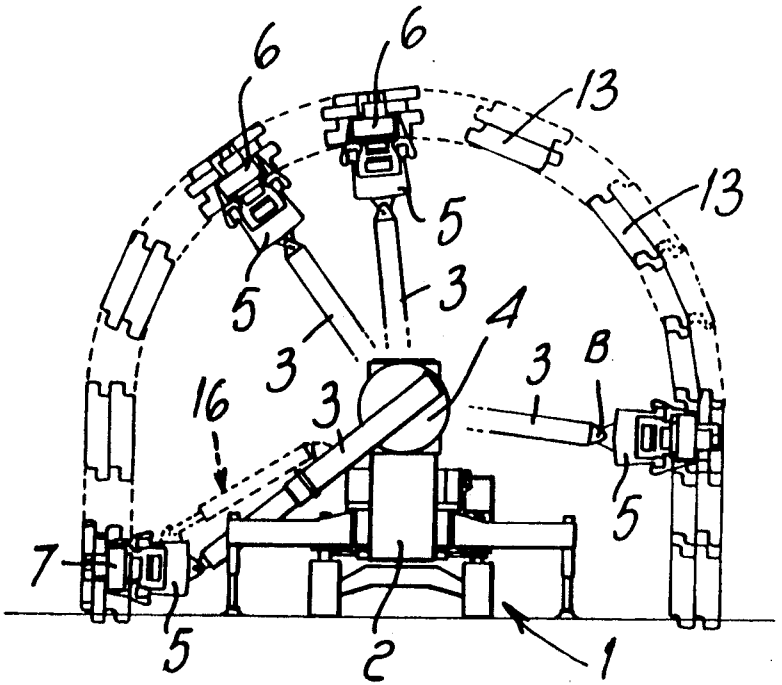
Figure 6:
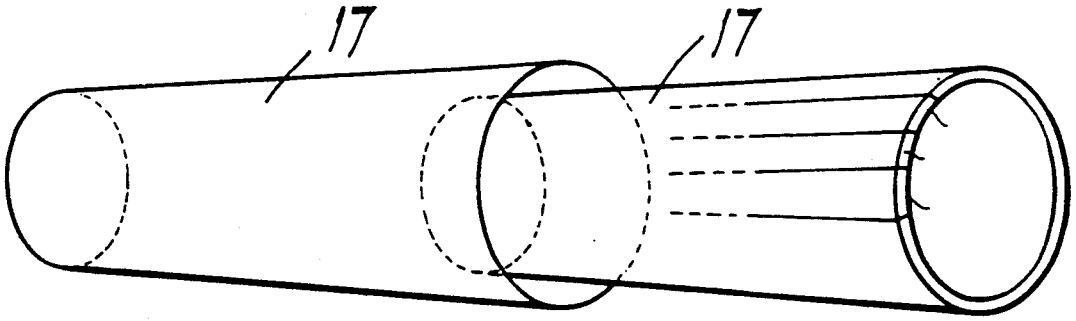
Figure 4:
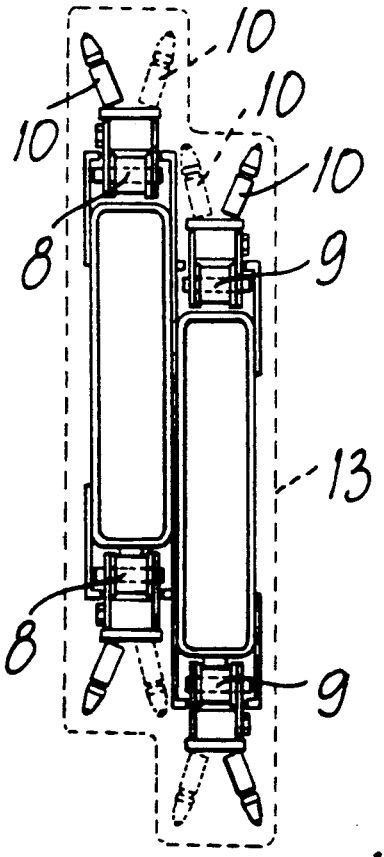
Figure 7:
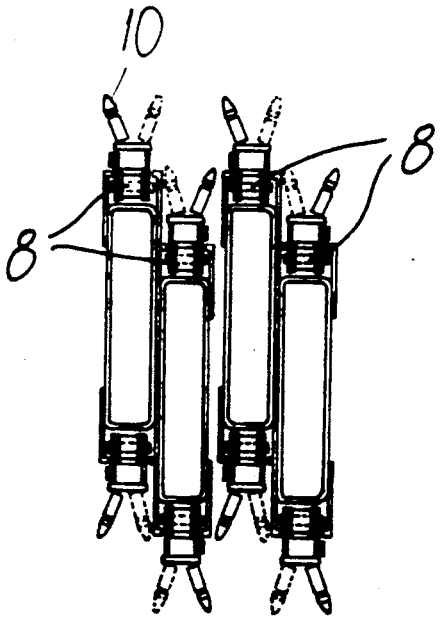
Figure 8:
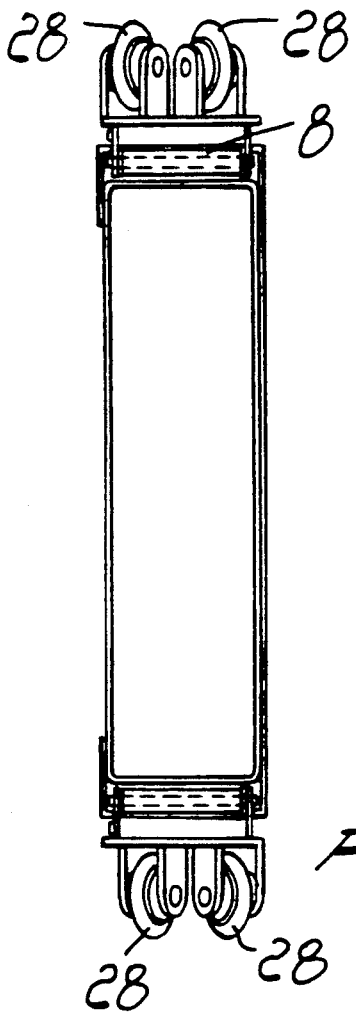
Figure 9:
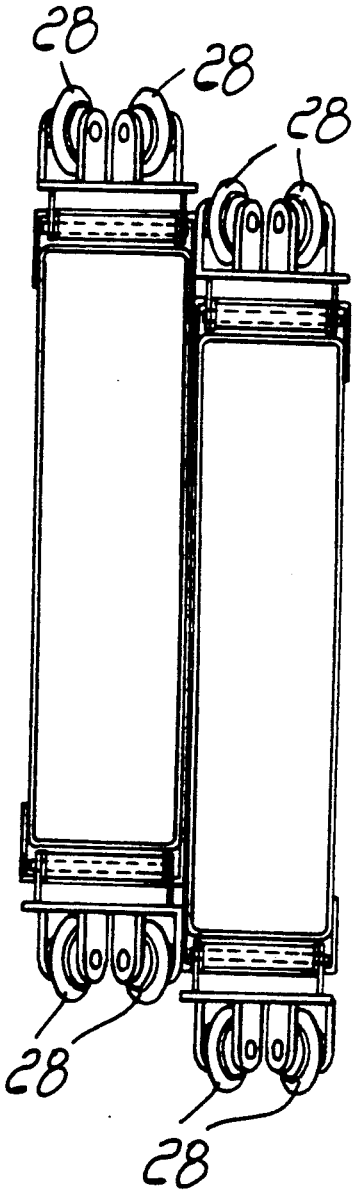
Figure 10:
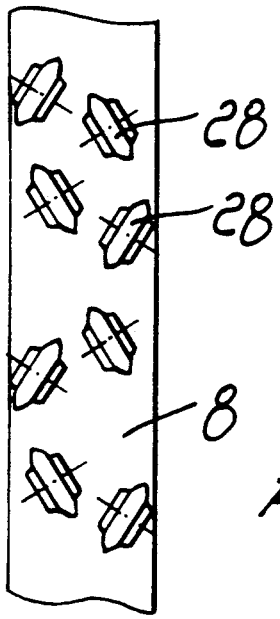
Figure 11:
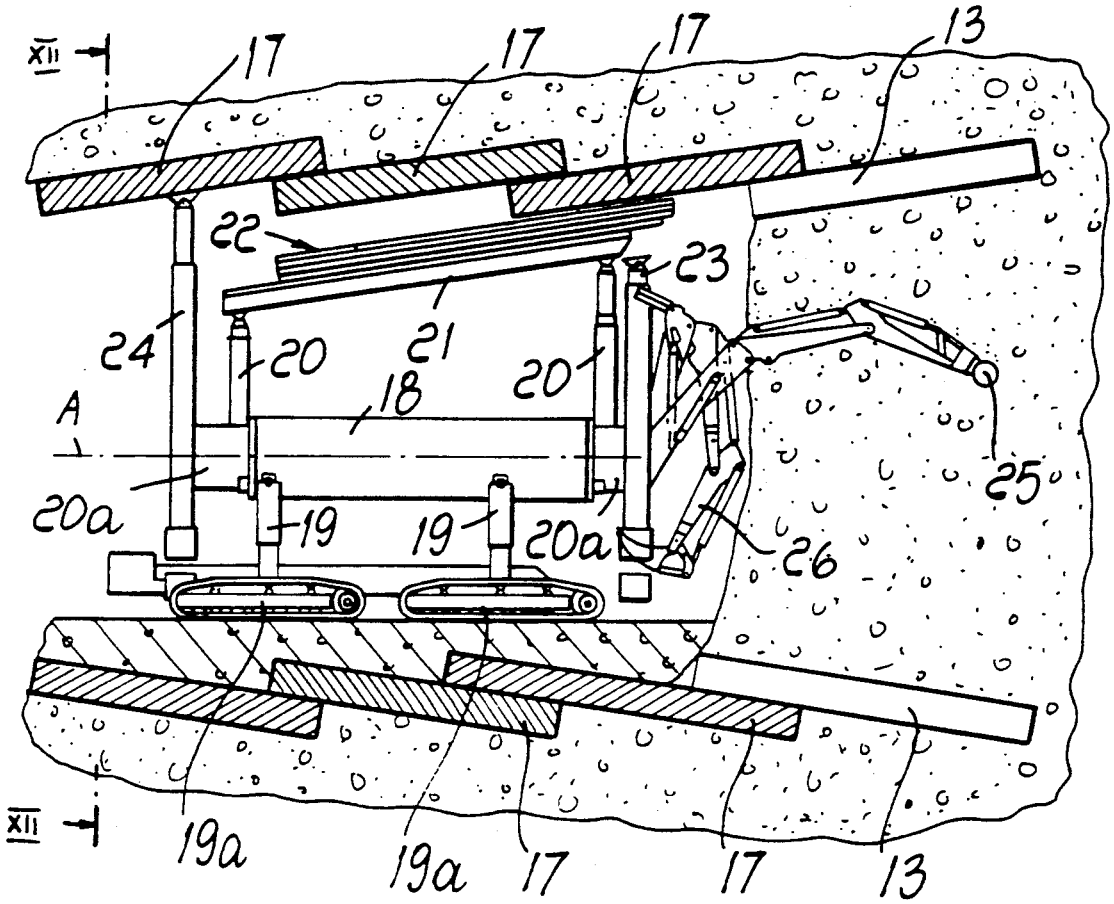
Figure 13:
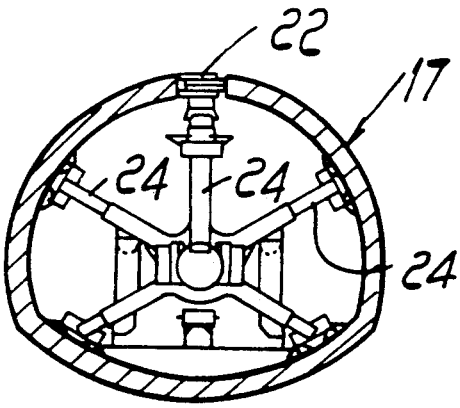
Figure 12:
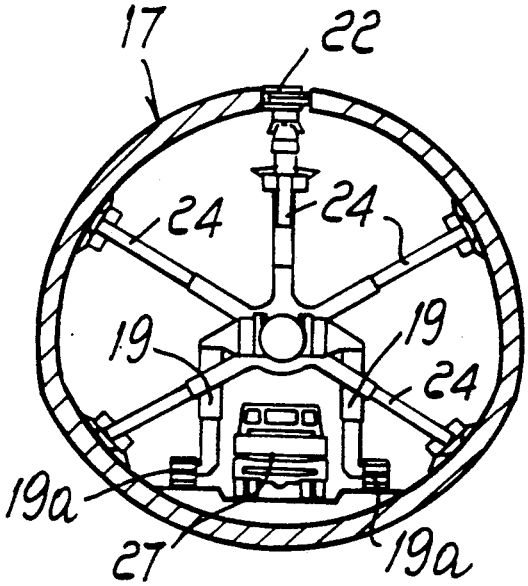

FIG. *2a* is a transverse sectional elevation view of a lining;

FIG. *2b* is a schematic longitudinal sectional view of three vaults;

FIG. 3 is a schematic view of an apparatus used for tunnelling;

FIG. 4 is a schematic transverse sectional view of a chain-equipped excavation tool;

FIG. 5 is a transverse sectional elevation view of a tunnel with an apparatus inside and with the excavation tool in various working positions;

FIG. 6 is a schematic view of two portions of a final supporting structure;

FIG. 7 is a schematic transverse sectional view of a further chain-equipped excavation tool;

FIGS. 8 and 9 are schematic views of two excavation tools provided with a rotary excavation element;

FIG. 10 is a front view of a portion of the excavation tools of FIGS. 8 and 9;

FIG. 11 is a view of an apparatus for providing a self-supporting lining;

FIG. 12 is a sectional view taken along the plane XII—XII of FIG. 11, and FIG. 13 is a sectional view, similar to that of FIG. 12 but related to a smaller tunnel.

DESCRIPTION OF THE PREFERRED EMBODIMENTS

With reference to FIGS. 1-5, a self-propelled tracked apparatus, generally indicated at 1, is used to perform the method. The apparatus 1 comprises an advancement unit 2 on which two jacks 3 are frontally and rearwardly mounted and supported on respective rotational fifth wheels 4 so as to be rotatable about a same axis A. The jacks 3 are mutually parallel and their stems articulately support (point B), at their top, a framework 5 for slidingly supporting an excavation or boring tool 6 which is protrudingly supported by the framework 5 and is actuated by a drive unit 7.

The excavation tool 6 (see FIG. 4) is constituted by two parallel chains 8,9 which bear each two rows of externally protruding excavation teeth 10.

The chains 8 and 9 extend between a pair of drive pulleys 11 on one side and a pair of driven pulleys 12 on the other. The two drive pulleys 11 are coaxial, whereas the two driven pulleys 12 are axially offset so that the chains diverge toward the driven pulleys. In this manner the excavation front of the tool 6, as is more clearly shown in FIG. 4, has a substantially Z-shaped configuration toward the driven pulleys. In FIG. 3, for the sake of clarity, the excavation tool 6 is shown in a position which is rotated by 90° with respect to the actual one, which is shown in FIG. 5.

The method for the preliminary consolidation of tunnel excavations develops as follows.

The apparatus 1 is initially arranged coaxially to the tunnel, i.e. so that the rotation axis A of the excavation tool coincides with the longitudinal axis of said tunnel. The excavation tool 6 is aligned at the point of the extrados which is to be excavated. Then the tool is advanced, by means of the drive unit 7, along the framework 5 so that the chains, penetrating in the soil, form a cavity 13. The direction of the excavating tool is conveniently slightly inclined upward toward the driven pulleys 12 with respect to the axis of the tunnel. The two chains 8 and 9 perform a rotary movement in opposite directions which ensures that the preset direction is maintained and that the excavated material is removed outward. Due to the divergent arrangement of the chains, the cavity 13 has a rectangular cross section with mutually offset protrusions on he opposite smaller sides of the rectangle, thus defining a Z-like shape.

Once the cavity 13 has been completed, the tool 6 is extracted from said cavity and, after a rotation through a preset angle, is placed at a new point to be excavated.

At the same time, the previously excavated cavity is filled with concrete injected according to the "spritzbeton" or beton spraying technique, forming a voussoir 14 which is shaped complimentarily o the cavity 13. The excavation points are chosen taking into account the characteristics of the soil in order to avoid decompression phenomena. It is thus possible to excavate cavities at regular distances, for example as illustrated in FIG. 5, also to allow the injected concrete to set.

The above steps are repeated until an entire vault 15, formed by the union of the voussoirs 14, is defined, after which the apparatus 1 is removed to allow the access of an appropriate excavation apparatus which removes the soil inside the vault, i.e. inside the tunnel intradoes. This excavation can be performed with the same conventional means used for wells and trenches. The depth of the excavation extends to a preset distance from the excavation backwall of the vault to allow the partial overlap of the subsequent vault.

Once the vault 15 has been completed, a subsequent vault 15' is produced in the same manner starting from the new excavation front.

As can be seen, the so obtained vaults have a frustum-like shape which widens in the advancement direction.

In this manner it is possible to provide a lining in which the vaults overlap like the tiles of a roof. It should also be noted that during excavation of the semicircular section of the vault the excavation tool remains radially fixed relative to the jacks 3. However, the articulations B allow the excavation tool to be orientated with respect to the jacks, in particular during the execution of the vertical masonry structures of the lining, as shown in FIG. 5. The orientation of the excavation tool is obtained by means of further jacks 16 which act, for example, between the framework 5 and the jacks 3.

Figure 1:
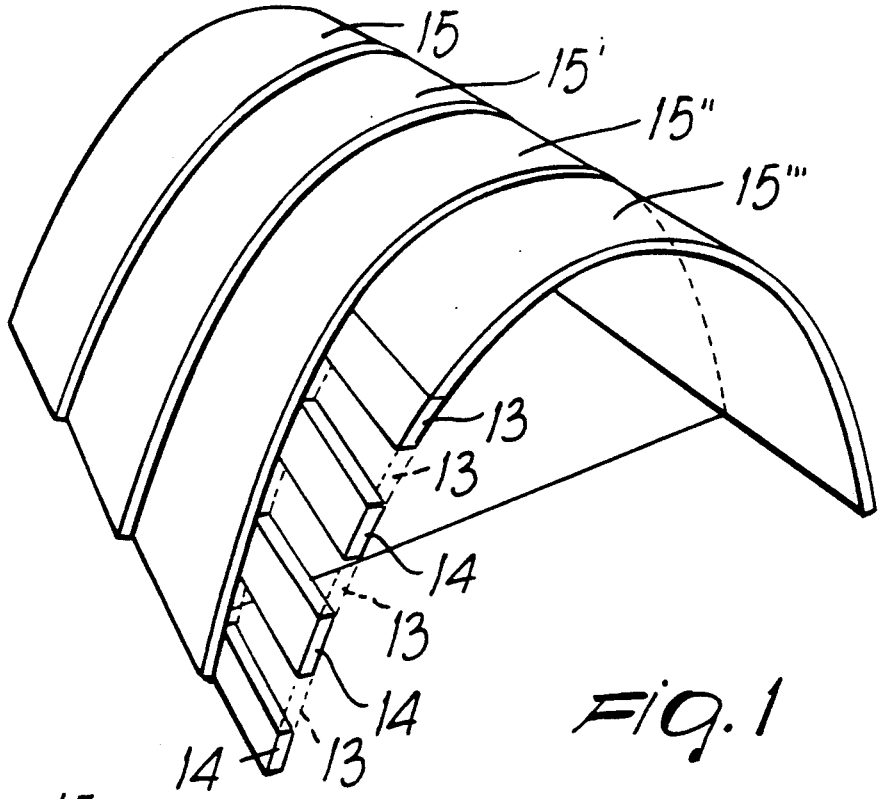
FIG. 1 is a schematic view of a lining of a section of tunnel.
Figure 2A:
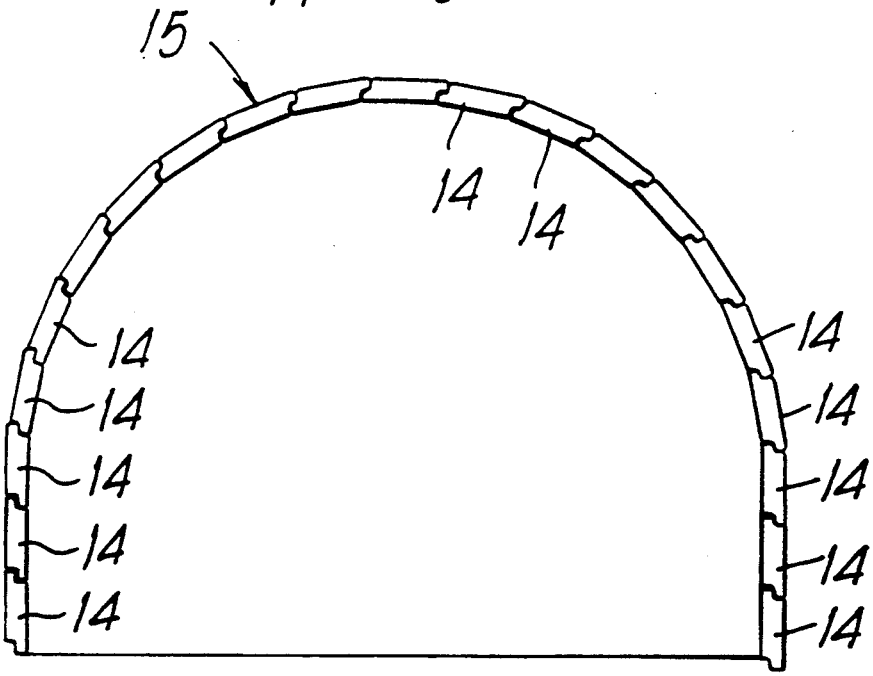
Figure 2B:
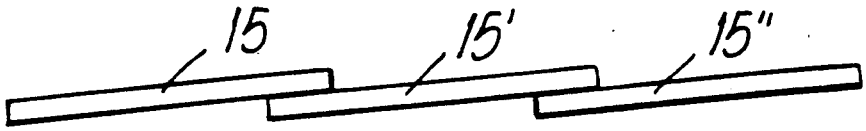

The described method is furthermore applicable to form self-supporting linings to which reference is made in FIGS. 6 and 11–13. As can be deduced from FIG. 6, the tunnel comprises frustum-shaped vaults 17 which, differently from the open ones shown in FIGS. 1, 2*a* and 2*b*, are closed in a tube-like fashion. The vaults can have a circular cross section or have a multicentric geometry, as shown in figures 12 and 13.

The apparatus for carrying out this embodiment of the method comprises an advancement unit 18 which rests on the ground by means of tracks 19*a* which are connected to the unit 18 by means of vertically extendable jacks 19.

Two respective jacks 20 are arranged at the opposite ends of the advancement unit 18 and are rotatable about the horizontal axis A by means of rotatable supports 20*a*.

The jacks 20 pivotedly support a framework 21 on which the excavation tool 22 is slidably mounted. The excavation tool and the moving means are fully identical to those described in the previous example.

The advancement unit furthermore has, at each end, but in a stationary manner with respect to the jacks 20, a plurality of front and rear telescoping arms, indicated at 23 and 24 respectively, which are arranged radially and allow the apparatus to be anchored to the wall of the section of tunnel which has already been bored.

The tunnel is excavated as above explained, making sure that when the excavation tool must operate in front of a front arm 23 said arm is retracted so as to not hinder the advancement of the tool. In any case the apparatus remains firmly anchored by means of the remaining arms. However, it should be noted that by virtue of anchoring provided by the telescoping arms it is possible to obtain a greater axial thrust on the excavation tool and therefore provide deeper cavities for accommodating voussoirs of significantly greater dimensions as well as greater precision in providing said cavities, since movements of the apparatus are eliminated.

The apparatus can advantageously be provided with suitable excavation tools 25, mounted on movable arms 26 ahead of the advancement unit, said movable arms 26 allowing the soil inside the executed vault to be removed without moving back the apparatus. The type of excavation tool is chosen according to the kind of soil to be removed.

For example, the soil can be removed from the excavation area by means of rotating disks and a conveyor belt arranged below the apparatus (see FIG. 13).

It should be noted that the jacks 19 and the extendibility of the telescoping arms 23 and 24 allow, in the case of larger tunnels, to place the advancement unit at such a level as to allow the passage of yard vehicles 27 (see FIG. 12) below it.

In alternative embodiments of the invention, the excavation tool can comprise two pairs of chains (FIG. 7) and/or have, instead of the excavation teeth 10, appropriate "chisels" 28 which rotate about pivots and can be orientated with respect to the sliding direction of the chains (FIGS. 8–10). In this case, the excavation tool can be of the kind with a single chain (FIG. 8) or with a double chain (FIG. 9).

The advantages obtainable with the described apparatus can be thus summarized:

- high constructive and operational economy with respect to conventional devices;
- the final self-supporting lining structure is injected before the very tunnel is bored;
- the possibility of varying the initial excavation position of the excavation tool allows to use the same apparatus for any tunnel geometry to be provided;
- the possibility of varying the position of the center of rotation of the apparatus allows the supporting structure to be formed using various rotation centers which correspond to those of a multicentric curve;
- the first excavation step for obtaining only the self-supporting lining structure allows to use lower thrust and cutting power and therefore to produce considerable thicknesses for deeper sections;
- the excavation tools adopted, which are interchangeable, allow to easily bore any kind of soil or rock, ensuring, in any condition, obtainment of a uniform supporting structure with excellent mechanical characteristics regardless of the nature of the soil, with any thickness and with advancement sections of considerable length;
- the immediate execution of the final self-supporting lining structure avoids the need to adopt extremely expensive preliminary consolidation interventions which are merely temporary, are conditioned in their effectiveness by the uniformity or lack thereof of the soil and condition the work progress time;
- in extremely loose soil the use of this method eliminates the problems of environmental impact consequent to the need to use, in order to perform the preliminary consolidations, highly penetrating consolidation mixes based on polluting components;
- the subsequent excavation of the very tunnel is performed in total safety conditions, since in practice it is a matter of "emptying" a tunnel the contour whereof has already been bored, and therefore with extremely rapid progress times;
- the subsequent excavation for removing the soil in the tunnel can be performed with conventional methods;
- at the end of the excavation of the very tunnel, the latter is practically complete, unless a possible decorative and/or sound-deadening prefabricated lining is installed at the sides of the tunnel or unless a possible "sanding" of the walls of the voussoirs is performed, with the addition of a small layer of leveling "spritz-beton";
- the overlap of the various truncated cones which constitute the individual sections can however create per se an architectural motif, besides reducing noise and the "piston" effect consequent to the transit of circulating vehicles.

I claim:

1. An apparatus for tunnelling comprising an advancement unit, a framework, means for rotatably supporting and angularly positioning said framework on said advancement unit about a longitudinal axis of a tunnel to be bored, an excavation tool mounted on said framework so as to be longitudinally slidable thereon, means for actuating said tool along said framework, said supporting means comprising a pair of parallel jacks radially extending with respect to said longitudinal ax is and means for orientating said framework with respect to said jacks so that said excavation tool moves in a divergent direction with respect to said longitudinal axis of the tunnel, said excavation tool comprising at least two chains provided with excavation elements, each chain being wound around a respective drive pulley and around a respective driven pulley said drive pulleys being coaxial and said driven pulleys being axially offset so that said chains have divergent rectilinear portions.

2. An apparatus according to claim 1, wherein said excavation elements comprise excavation teeth.

3. An apparatus according to claim 1, wherein said excavation elements comprise rotating chisels having an adjustable plane of rotation with respect to said chains.

* * * * *